US008869809B2

(12) United States Patent
Johnson

(10) Patent No.: US 8,869,809 B2
(45) Date of Patent: Oct. 28, 2014

(54) SHAVING SYSTEM

(75) Inventor: Theresa Louise Johnson, South Lebanon, OH (US)

(73) Assignee: The Gillette Company, Boston, MA (US)

( * ) Notice: Subject to any disclaimer, the term of this patent is extended or adjusted under 35 U.S.C. 154(b) by 1841 days.

(21) Appl. No.: 12/011,413

(22) Filed: Jan. 25, 2008

(65) Prior Publication Data

US 2008/0209733 A1 Sep. 4, 2008

Related U.S. Application Data

(60) Provisional application No. 60/900,889, filed on Feb. 12, 2007.

(51) Int. Cl.

| | |
|---|---|
| ***A45D 27/22*** | (2006.01) |
| ***A45D 40/00*** | (2006.01) |
| ***B26B 21/44*** | (2006.01) |
| ***B26B 21/40*** | (2006.01) |

(52) U.S. Cl.

CPC ..... *B26B 21/40* (2013.01); *B26B 21/44* (2013.01); *A45D 27/22* (2013.01); *B26D 21/405* (2013.01)

USPC ..... 132/289; 132/286; 30/537; 30/538

(58) Field of Classification Search

USPC ..... 132/286, 289, 290, 292, 309, 310; 30/34.05, 41, 41.5, 535, 537, 538, 122; 401/195; 451/523–525; 606/131

See application file for complete search history.

(56) References Cited

U.S. PATENT DOCUMENTS

| | | | | |
|---|---|---|---|---|
| 3,809,977 | A | 5/1974 | Balamuth et al. | |
| 4,285,428 | A * | 8/1981 | Beddall et al. | 206/354 |
| 4,683,897 | A * | 8/1987 | McBride | 132/73.6 |
| 4,918,818 | A | 4/1990 | Hsieh | |
| 5,134,775 | A * | 8/1992 | Althaus et al. | 30/41 |
| 6,441,589 | B1 | 8/2002 | Frerking et al. | |
| 6,471,712 | B2 * | 10/2002 | Burres | 606/131 |
| 6,598,609 | B2 * | 7/2003 | Gibbs | 132/289 |
| 6,895,624 | B2 * | 5/2005 | Fischer et al. | 15/22.1 |
| 2005/0000537 | A1 * | 1/2005 | Junkins | 132/309 |
| 2007/0220753 | A1 * | 9/2007 | Aviza | 30/34.05 |

* cited by examiner

*Primary Examiner* — Rachel Steitz

(74) *Attorney, Agent, or Firm* — Joanne N. Pappas; Kevin C. Johnson; Steven W. Miller

(57) ABSTRACT

A shaving system including a handle, a first head and a second head. The handle includes a power source and a head attachment member. The first head includes a rotating member. The first head is attachable to the handle by the head attachment member. The power source supplies power to the first head to rotate the rotating member. The second head includes a plurality of razor blades. The second head is attachable to the handle by the head attachment member.

9 Claims, 5 Drawing Sheets

SHAVING SYSTEM

CROSS REFERENCE TO RELATED APPLICATIONS

This application claims the benefit of U.S. Provisional application No. 60/900,889, filed Feb. 12, 2007.

FIELD OF THE INVENTION

The present invention relates to a shaving system and more particularly to a shaving system having a handle, a first head performing a pre-shave function and a second head having a plurality of razor blades for performing the shaving function.

BACKGROUND OF THE INVENTION

Ultrasonic devices performing a variety of functions are known. Such devices include a converter that increases the frequency of the current to an ultrasonic rate. The converter is connected to a motor which converts the electrical energy into mechanical vibrations at an ultrasonic rate. A series of accessories are typically provided to be used with the ultrasonic motor. The accessories are interchangeable to produce a series of effects. Examples of such accessories include a razor, water pick, toothbrush and a prophylaxis unit.

Multi-purpose massage and shaving devices are also known. The devices are designed to shave off the beard and then used to massage the body surface from where the beard has been shaved off. The massage is performed via vibration.

Another group of multi-purpose massage and shaving devices are known. These devices are designed to not only shave but also to massage other surfaces other than the body surface that was just shaved. For example, the device is designed to be able to massage the gums of the teeth and socket bones of the eye. The massage is performed via vibration.

It would be beneficial to provide a shaving system that could prepare the skin for shaving and then be used to shave. Today such pre-shave preparation is done with a separate device such as a separate brush. The brush is used to lift hair on end prior to shaving.

SUMMARY OF THE INVENTION

In accordance with the present invention a shaving system is provided. The shaving system comprises a handle, a first head and a second head. The handle comprises a power source and a head attachment member. The first head comprises a rotating member. The first head is attachable to the handle by the head attachment member. The power source supplies power to the first head to rotate the rotating member. The second head comprises a plurality of razor blades. The second head is attachable to the handle by the head attachment member.

In accordance with another aspect of the present invention the shaving system comprises a third head. The third head is attachable to the handle by the head attachment member. The third head comprises a compartment for housing an after shave solution. The third head comprises a port for delivering the after shave solution to a user's skin.

In accordance with another aspect of the present invention, the second head comprises a compartment for housing a shaving solution. The second head comprises a port for delivering the shaving solution to a user's skin.

The rotating member preferably comprises an abrasive surface. The abrasive surface scrubs away dirt and dead skin. The abrasive surface also lifts the hair on end prior to shaving.

The shaving system preferably comprises a stand for holding the components of the system such as the handle, the first head, the second head and the third head.

The shaving system preferably comprises a power source selected from the group consisting of a replaceable battery, a rechargeable battery, a renewable battery, and a renewable fuel cell. The replaceable battery is one of an alkaline battery, a lithium battery, and a zinc-air battery. The rechargeable battery is one of a NiCd battery, a $NiH_2$ battery, a NiMH battery, a Li-ion battery, a Li-polymer battery, a zinc-air battery and a lead acid battery.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Figure 1:
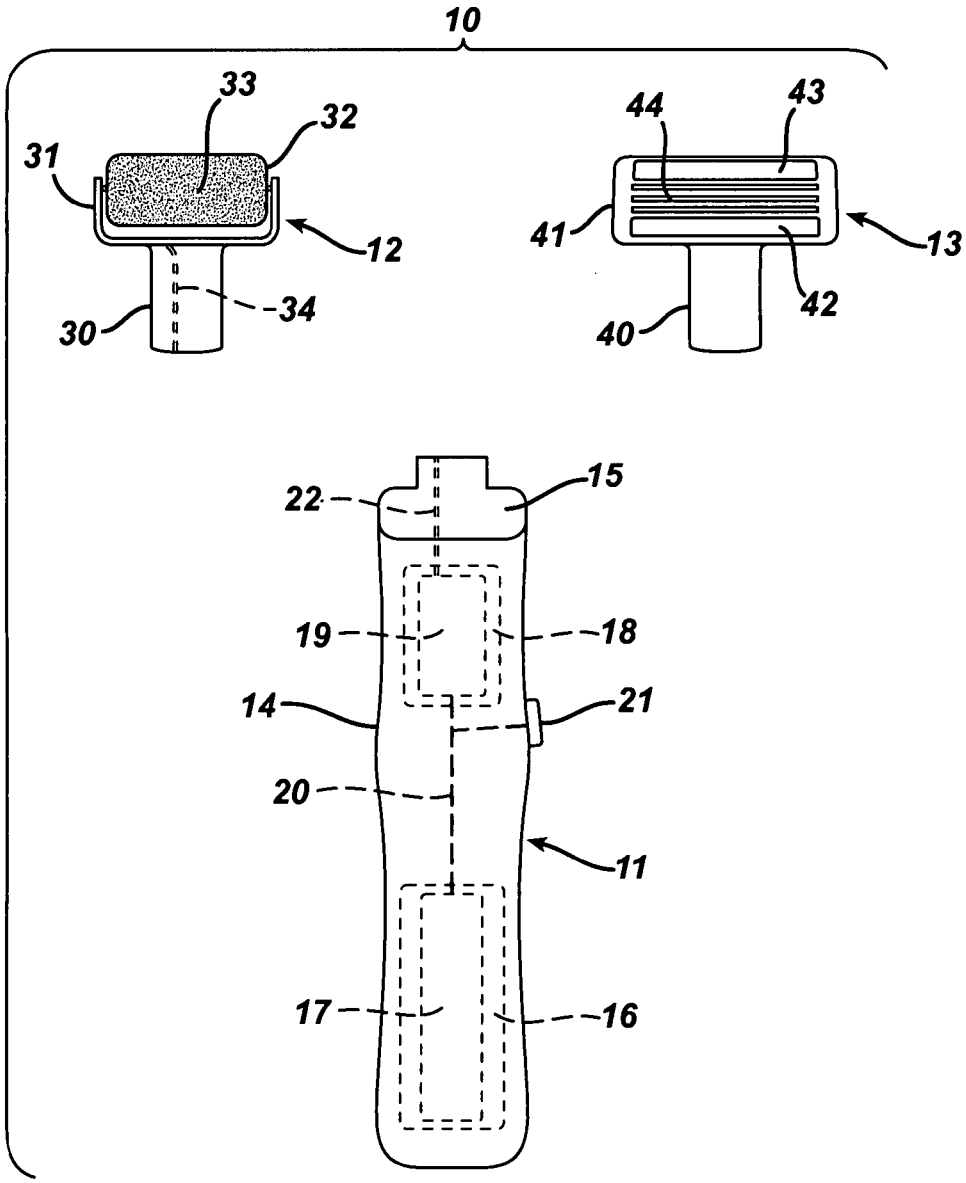
FIG. 1 is a view of a shaving system of the present invention.

Referring now to FIG. 1 there is shown a shaving system 10 of the present invention. The shaving system 10 comprises a handle 11, a first head 12 and a second head 13. The handle 11 comprises a body 14. Body 14 has a head attachment member 15 at one end thereof for attaching first head 12 and second head 13, respectively, to handle 11. Handle 11 comprises a power compartment 16 for housing a power source 17. Handle 11 comprises a motor compartment 18 for housing motor 19. Motor 19 is electrically connected to power source 17 through electrical connection 20. A switch 21 is provided on handle 11 to turn motor 19 off and on. Switch 21 can be a toggle, slide, push button or other type of switch.

The power source 17 is selected from the group consisting of a replaceable battery, a rechargeable battery, a renewable battery, and a renewable fuel cell. The replaceable battery may be one of an alkaline battery, a lithium battery, and a zinc-air battery. The rechargeable battery may be one of a NiCd battery, a $NiH_2$ battery, a NiMH battery, a Li-ion battery, a Li-polymer battery, a zinc-air battery and a lead acid battery.

The first head 12 comprises a handle attachment member 30 for attaching first head 12 to head attachment member 15 of handle 11. A mounting bracket 31 extends from handle attachment member 30 for holding rotating member 32. The power source 17 supplies power to the first head 12 to rotate the rotating member 32. Specifically power source 17 supplies power to motor 19 which moves shaft 22 in an up and down movement. Shaft 22 translates the up and down movement to linkage 34 of first head 12. Linkage 34 moves within mounting bracket 31 to rotate rotating member 32. Rotating member 32 comprises an abrasive surface 33. As rotating member is brought into contact with the user's skin the abrasive surface 33 scrubs away dirt and dead skin and lifts the hair away from the skin.

The second head 13 comprises a handle attachment member 40 for attaching second head 13 to head attachment member 15 of handle 11. A housing 41 is joined to handle attachment member 40. Housing 41 comprises a guard 42, a cap 43, and a plurality of razor blades 44 positioned between guard 42 and cap 43. Guard 42 is positioned in front of razor blades 44 and contacts the skin prior to razor blades 44 during a shaving stroke. Cap 43 is positioned behind razor blades 44 and contacts the skin after razor blades 44 during a shaving stroke.

With first head 12 attached to handle 11 a user rubs rotating member 32 against the skin allowing abrasive surface 33 to remove dirt, dead skin and to lift the hair away from the skin. By lifting the hair away from the skin the user positions the hair in a better position to be cut by razor blades 44. After a user is finished using first head 12 he/she removes first head 12 from handle 11 and replaces it with second head 13. The user then shaves using second head 13 allowing razor blades 44 to cut the user's hair.

Figure 2:
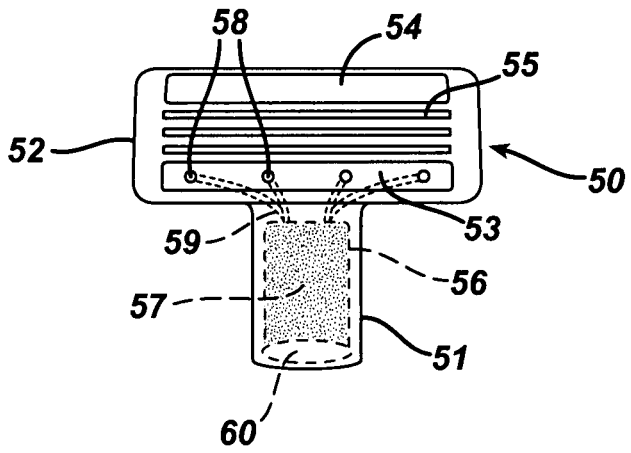
FIG. 2 is a view of another second head of the present invention.

Referring now to FIG. 2 there is shown another second head 50 of the present invention. Second head 50 comprises a handle attachment member 51 for attaching second head 50 to head attachment member 15 of handle 11. A housing 52 is joined to handle attachment member 51. Housing 52 comprises a guard 53, a cap 54, and a plurality of razor blades 55 positioned between guard 53 and cap 54. Guard 53 is positioned in front of razor blades 55 and contacts the skin prior to razor blades 55 during a shaving stroke. Cap 54 is positioned behind razor blades 55 and contacts the skin after razor blades 55 during a shaving stroke.

Second head 50 comprises a compartment 56 for housing a shaving solution 57. The second head 50 comprises a series of ports 58 for delivering the shaving solution 57 to a user's skin. Ports 58 are located on guard 53 of housing 52. A tube 59 connects compartment 56 to ports 58 to deliver shaving solution from compartment 56 to ports 58. Ports 58 may be located on cap 54. A pump 60 is located adjacent compartment 56. Pump 60 is powered by shaft 22 in handle 11. Pump 60 pumps shaving solution 57 from compartment 56 through tube 59 to ports 58.

Figure 3:
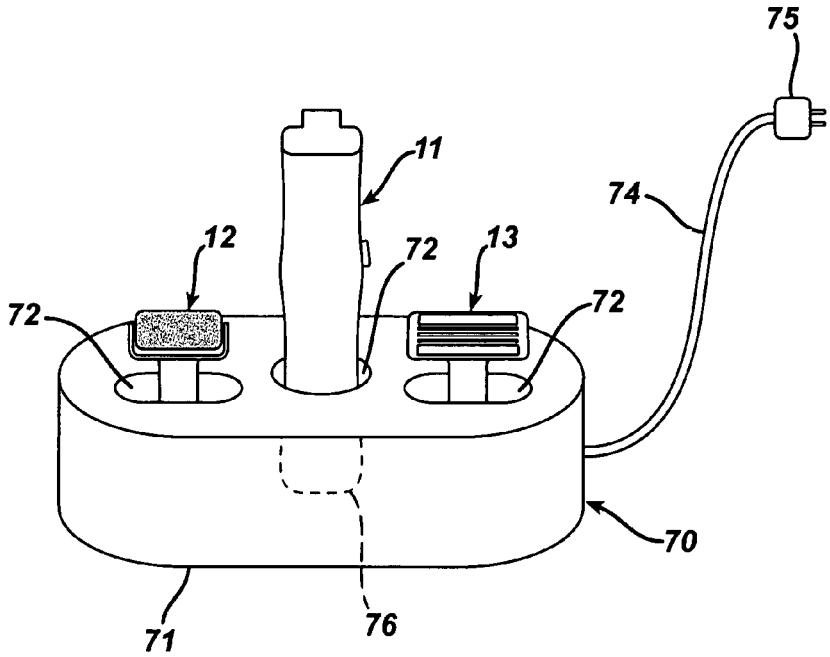
FIG. 3 is a view of a shaving system of the present invention in a stand.

Referring now to FIG. 3 there is shown a stand 70 of the present invention. Stand 70 has base 71 for resting stand 70 on a surface such as a counter top. Stand 70 also has a series of ports 72 for housing the shaving system of the present invention. Stand 70 shown is shown with three ports 72 for housing handle 11, first head 12, and second head 13. A cord 74 having a plug 75 joined thereto extends from stand 70. When plug 75 is plugged into an outlet recharge station 76 can charge a rechargeable power source in handle 11.

Figure 4:
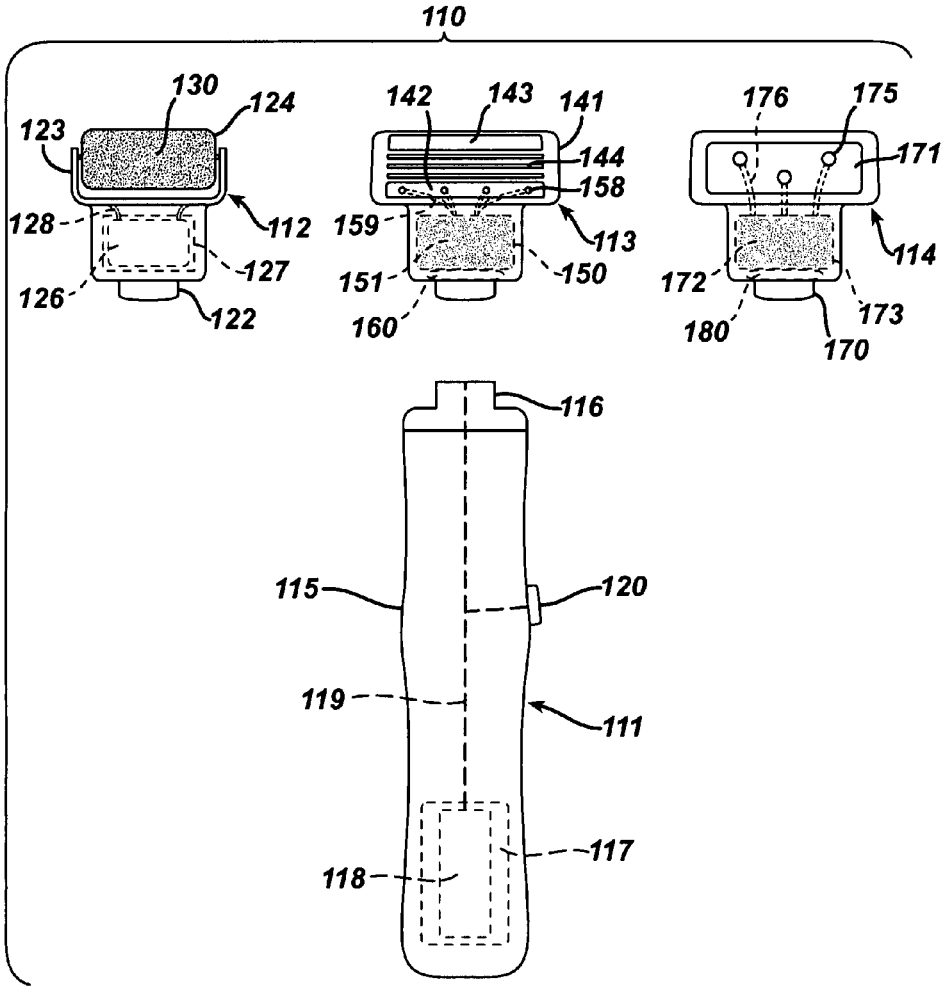
FIG. 4 is a view of another shaving system of the present invention.

Referring now to FIG. 4 there is shown a shaving system 110 of the present invention. The shaving system 110 comprises a handle 111, a first head 112, a second head 113 and a third head 114. The handle 111 comprises a body 115. Body 115 has a head attachment member 116 at one end thereof for attaching first head 112, second head 113 and third head 114 to handle 111. Handle 111 comprises a power compartment 117 for housing a power source 118. An electrical connection 119 extends from power source 118 to head attachment member 116 to provide power to a head that is attached to handle 111. A switch 120 is provided along connection 119 and serves to open and close the electrical circuit along connection 119. Switch 120 can be a toggle, slide, push button or other type of switch.

The power source 118 is selected from the group consisting of a replaceable battery, a rechargeable battery, a renewable battery, and a renewable fuel cell. The replaceable battery may be one of an alkaline battery, a lithium battery, and a zinc-air battery. The rechargeable battery may be one of a NiCd battery, a $NiH_2$ battery, a NiMH battery, a Li-ion battery, a Li-polymer battery, a zinc-air battery and a lead acid battery.

The first head 112 comprises a handle attachment member 122 for attaching first head 112 to head attachment member 116 of handle 111. A mounting bracket 123 extends from handle attachment member 122 for holding rotating member 124. The power source 118 supplies power to motor 126 housed in motor compartment 127 in first head 112. Motor 126 rotates rotating member 124 through a linkage 128. Linkage 128 moves within mounting bracket 123 to rotate rotating member 124. Rotating member 124 comprises an abrasive surface 130. As rotating member 124 is brought into contact with the user's skin abrasive surface 130 scrubs away dirt and dead skin and lifts the hair away from the skin.

The second head 113 comprises a handle attachment member 140 for attaching second head 113 to head attachment member 116 of handle 111. A housing 141 is joined to handle attachment member 140. Housing 141 comprises a guard 142, a cap 143, and a plurality of razor blades 144 positioned between guard 142 and cap 143. Guard 142 is positioned in front of razor blades 144 and contacts the skin prior to razor blades 144 during a shaving stroke. Cap 143 is positioned behind razor blades 144 and contacts the skin after razor blades 144 during a shaving stroke.

Second head 113 comprises a compartment 150 for housing a shaving solution 151. The second head 113 comprises a series of ports 158 for delivering the shaving solution 151 to a user's skin. Ports 158 are located on guard 142 of housing 141. A tube 159 connects compartment 150 to ports 158 to deliver shaving solution 151 from compartment 150 to ports 158. A pump 160 pumps shaving solution 151 from compartment 150 through tube 159 and eventually to ports 158. Pump 160 is electrically connected to power source 118.

Third head 114 comprises a handle attachment member 170 for attaching third head 114 to head attachment member 116 of handle 111. Third head 114 includes an applicator 171 for delivering an after shave solution 172 to a user's skin.

Third head 114 comprises a compartment 173 for housing an after shave solution 172. The third head 114 comprises a series of ports 175 for delivering the after shave solution 172 to a user's skin. Ports 175 are located underneath applicator 171. A tube 176 connects compartment 173 to ports 175 to deliver after shave solution 172 from compartment 173 to ports 175. A pump 180 pumps after shave solution 172 from compartment 173 through tube 176 and eventually to ports 175. Pump 180 is electrically connected to power source 118.

With shaving kit 110, a user first attaches first head 112 to handle 111. The user rubs abrasive surface 130 of rotating member 124 against the skin to remove dirt, dead skin and to lift the hair away from the skin. By lifting the hair away from the skin the user positions the hair in a better position to be cut by razor blades 144. After a user is finished using first head 112 he/she removes first head 112 from handle 111 and replaces it with second head 113. The user then shaves using second head 113 allowing razor blades 144 to cut the user's hair. During shaving, the user can apply shaving solution 151 to the user's skin. Shaving solution 151 can be applied by turning on switch 120 on handle 111 to deliver power to pump 160. After shaving, second head 113 is removed and replaced with third head 114. A user applies after shave solution 172 to the skin by turning on switch 120 on handle 11 to deliver power to pump 180. Solution 172 is delivered to applicator 171 where it can be applied directly to a user's skin.

Figure 5:
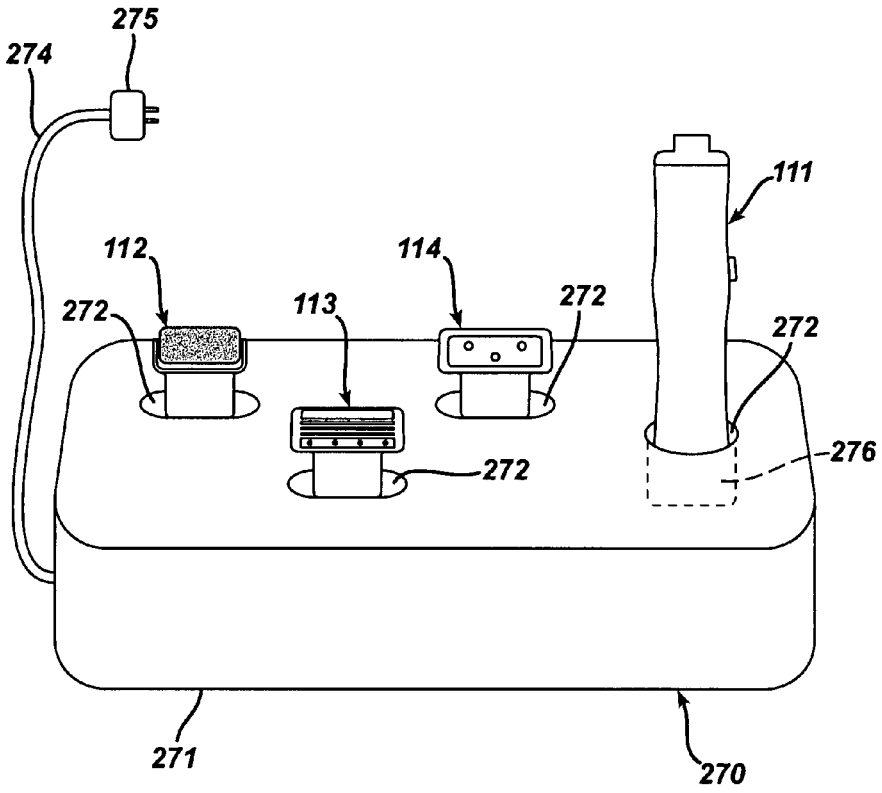
FIG. 5 is a view of a shaving system of the present invention in a stand.

Referring now to FIG. 5 there is shown a stand 270 of the present invention. Stand 270 has base 271 for resting stand 270 on a surface such as a counter top. Stand 270 also has a series of ports 272 for housing the shaving system of the present invention. Stand 270 shown is shown with four ports 272 for housing handle 111, first head 112, second head 113 and third head 114. A cord 274 having a plug 275 joined thereto extends from stand 270. When plug 275 is plugged into an outlet recharge station 276 can charge a rechargeable power source in handle 111.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving system comprising:

a handle, said handle comprising a power source and a head attachment member;

a first head, said first head comprising a rotating member, said first head being attachable to said handle by said head attachment member, said power source supplying power to said first head to rotate said rotating member for rubbing against a user's skin; and a second head, said second head comprising a plurality of razor blades, said second head being attachable to said handle by said head attachment member.

2. The shaving system of claim 1, said shaving system further comprising a third head, said third head being attachable to said handle by said head attachment member, said third head comprising a compartment for housing an after shave solution, said third head comprising a port for delivering said after shave solution to the user's skin.

3. The shaving system of claim 1, wherein said second head comprises a compartment for housing a shaving solution, said second head comprising a port for delivering said shaving solution to the user's skin.

4. The shaving system of claim 1 wherein said rotating member comprises an abrasive surface.

5. The shaving system of claim 1, said shaving system further comprising a stand for holding said handle, said first head and said second head.

6. The shaving system of claim 2, said shaving system further comprising a stand for holding said handle, said first head, said second head and said third head.

7. The shaving system of claim 1, wherein said power source is selected from the group consisting of a replaceable battery, a rechargeable battery, a renewable battery, and a renewable fuel cell.

8. The shaving system of claim 7, wherein the replaceable battery is one of an alkaline battery, a lithium battery, and a zinc-air battery.

9. The shaving system of claim 7, wherein the rechargeable battery is one of a NiCd battery, a $NiH_2$ battery, a NiMH battery, a Li-ion battery, a Li-polymer battery, a zinc-air battery and a lead acid battery.

* * * * *